US005416674A

United States Patent [19]

Murai

[11] Patent Number: 5,416,674

[45] Date of Patent: May 16, 1995

[54] BLACK LIGHT DISPLAY DEVICE

[75] Inventor: Yuzo Murai, Houya, Japan

[73] Assignee: Nippon Makisen Kogyo Co., Ltd., Tokyo, Japan

[21] Appl. No.: 111,471

[22] Filed: Aug. 23, 1993

[30] Foreign Application Priority Data

May 31, 1993 [JP] Japan ..... 5-129397

[51] Int. Cl.[6] ..... G09F 19/02

[52] U.S. Cl. ..... 362/84; 362/35; 362/806; 362/255; 362/348; 40/543

[58] Field of Search ..... 362/806, 811, 812, 84, 362/277, 282, 284, 286, 255, 256, 348, 35; 40/543, 554, 558, 473, 484, 493; 313/483, 484, 485

[56] References Cited

U.S. PATENT DOCUMENTS 3,791,058 2/1974 Mollica ..... 362/811
4,744,012 5/1988 Bergkvist ..... 362/84
4,841,155 6/1989 Ushida et al. ..... 362/84

*Primary Examiner*—Ira S. Lazarus
*Assistant Examiner*—Sara Sachie Raab
*Attorney, Agent, or Firm*—Dickstein, Shapiro & Morin

[57] ABSTRACT

An attractive displaying device whereby an ultraviolet radiation lamp, which is hidden from plain view, contains a transparent tube that coaxially receives the ultraviolet lamp and which is rotatable about an axial center line. Images are painted or printed on either the outer surface of the ultraviolet lamp, or on a substantially transparent film placed over the surface of the transparent tube, with a fluorescent ink which emits light when ultraviolet light is radiated upon it. The lighted images are projected onto a concave reflective surface, which may also have images painted on it with a fluorescent ink. The rotatable tube allows for movement of the images against the reflective surface; and a three dimensional effect can be achieved by making it look as if the projected images are passing behind the images that are painted on the reflective surface. The display unconventionally provides illuminated images against a dark background as opposed to a dark image against a light background. The highly illuminated images are clearly visible and highly attractive. If the transparent tube is omitted, then the images must be directly painted on the ultraviolet radiation lamp.

9 Claims, 16 Drawing Sheets

BLACK LIGHT DISPLAY DEVICE

TECHNICAL FIELD

The present invention relates to a display device which can effectively attract the attention of the viewer, and which is capable of providing a clear display of letters and picture images. In particular, the present invention relates to a black light display device which is suitable for advertisement and ornamental purposes.

BACKGROUND OF THE INVENTION

There is a conventionally known display device which includes a fluorescent lamp on which letters and picture images are painted. The fluorescent lamp display device typically consists of a "normal" fluorescent lamp, used for illumination purposes; a fluorescent layer coated on the inner surface of a glass tube, in a fluorescent lamp, is made to radiate white light, as a result of electric discharge taking place inside the glass tube. The letters and picture images are painted on the outer surface of the glass tube, typically by using color ink which contains thermo-setting binders.

However, according to such a conventional display device, since the letters and picture images are painted on the outer surface of the glass tube with thermo-setting color ink, and since the letters and picture images do not emit light, they are only visible to the naked eye as dark areas against a background of white light, which is emitted from the surface of the glass tube. Therefore, the images or objects displayed are not as clearly visible to the viewer as is desired: the unattractive device consequently does not draw any attention. As a result, this device is neither an effective tool for advertisement nor ornamentation.

BRIEF SUMMARY OF THE INVENTION

In view of such problems with the prior art, a primary object of the present invention is to provide a display device which is capable of producing clearly visible images as highly illuminated areas.

A second object of the present invention is to provide a display device which is capable of producing the displayed images as highly illuminated areas in a very attractive manner.

A third object of the present invention is to provide a display device, which is capable of clearly and visibly illuminating the displayed images, yet only requiring a simple and inexpensive structure.

According to the present invention, these objects can be accomplished by providing a display device, comprising: an ultraviolet radiation lamp; and an image painted or printed on an outer surface of the ultraviolet radiation lamp with a fluorescent ink which emits light when ultraviolet light emitted from the ultraviolet radiation lamp is radiated upon it.

Because the surface of the ultraviolet radiation lamp is either dark or substantially darker than the image that is painted or printed on it, the image can be viewed as a bright area against the dark background. As a result, the image is both highly visible and very attractive to the viewer. To facilitate the painting or printing of images (letters, pictures, symbols, etc.) on the ultraviolet radiation lamp, the image may be painted or printed on a substantially transparent film which is then placed over an outer surface of the ultraviolet radiation lamp. A particularly attractive appearance can be achieved when the display device further comprises a means for rotating the ultraviolet radiation lamp.

According to a particularly preferred embodiment of the present invention, the display device comprises: an ultraviolet radiation lamp; a substantially transparent tube coaxially receiving the ultraviolet radiation lamp therein; a means for rotating the transparent tube around an axial center line thereof; an image painted or printed on a surface of the tube with a fluorescent ink which emits light when ultraviolet light emitted from the ultraviolet radiation lamp is radiated upon it; a reflective plate, having a concave reflective surface facing an assembly consisting of the transparent tube and the ultraviolet radiation lamp, the reflective plate being placed behind the assembly as seen from the viewer; and means for hiding the assembly from direct view of the viewer.

By virtue of a concave reflective surface, the image that is projected onto the reflective plate, is viewed as moving or floating in the space, creating a particularly attractive appearance. In particular, when an image is painted or printed on a reflective surface of the reflective plate, the moving image can be viewed as three-dimensional image with respect to the fixed image on the reflective surface.

The display device may be additionally equipped with various other accessory features; for instance, it may include an LED display for displaying either stationary or moving letters and pictures, as well as a plaque for static display of information.

According to a preferred embodiment of the present invention, the display device may comprise a plaque made of a substantially transparent plate which is placed in front of an assembly, consisting of the transparent tube, and the ultraviolet radiation lamp; and an image painted or printed on a surface of the transparent plate with a fluorescent ink which emits light when ultraviolet light emitted from the ultraviolet radiation lamp is radiated upon it. Thus, not only does the image painted or printed on the transparent plate glow when ultraviolet light is radiated upon it, but, the fluorescent light which is emitted from the image painted on the outer surface of the ultraviolet radiation lamp passes through the image painted or printed on the transparent plate. Thus, two different colors are simultaneously mixed; one color is produced by the fluorescent ink which is painted on the transparent plate, while the other color is produced by the fluorescent light which is emitted from the image painted on the outer surface of the ultraviolet radiation lamp. The rotation of the tube causes the mixture to change color with the changing mixture of color given by the source of light. If the image on the tube consists of a spiral pattern, the color as shown on the surface of the transparent plate appears to move vertically. Thus, a highly attractive effect is produced.

Alternatively, this plaque may consist of an opaque plate, which has an opening with a prescribed shape, and a transparent sheet which covers the opening; the transparent sheet being coated with a fluorescent ink which emits light when ultraviolet light emitted from the ultraviolet radiation lamp is radiated upon it.

According to a particularly preferred embodiment of the present invention, the display device is accommodated in a hollow casing having a plurality of sides, and at least one of the sides includes: an opening; an assembly consisting of an ultraviolet radiation lamp, and a substantially transparent tube coaxially receiving the ultraviolet radiation lamp therein, the assembly being disposed inside the casing so as to be hidden from a direct view through the opening; an image painted or printed on a surface of the tube with a fluorescent ink which emits light when ultraviolet light emitted from the ultraviolet radiation lamp is radiated upon it; a means for rotating the transparent tube around an axial center line thereof; and a reflective plate, having a concave reflective surface facing an assembly consisting of the transparent tube and the ultraviolet radiation lamp, the reflective plate being placed behind the assembly as seen from the viewer in such a manner that the reflective surface forms an imaginary image, of the image on the tube, which can be viewed through the opening.

BRIEF DESCRIPTION OF THE DRAWINGS

Now the present invention is described in the following with reference to-the appended drawings, in which.

DETAILED DESCRIPTION OF THE PREFERRED EMBODIMENTS

Figure 1:
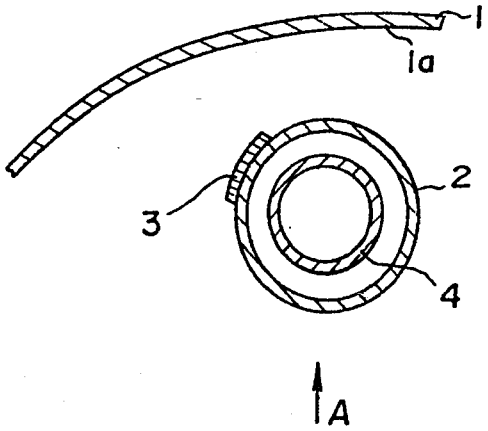
FIG. 1 is a sectional view showing a first embodiment of the display device of the present invention.

Referring to FIG. 1, which shows a first embodiment of the display device according the present invention, this display device comprises, a reflective plate 1 which is curved in an arcuate fashion resulting in a concave reflective surface la, and a transparent tube 2, which is located opposite the reflective surface 1*a* of the reflective plate 1.

Figure 2:
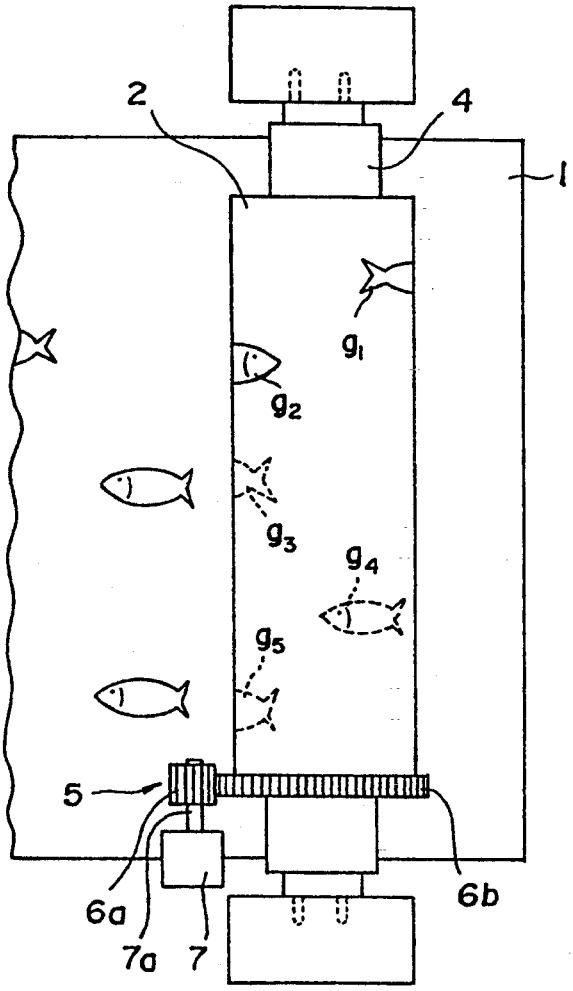
FIG. 2 is a front view of the first embodiment.

Various pictures of fish, g1 through g5, are painted on the outer surface of the tube 2 with fluorescent ink 3, as is best illustrated in FIG. 2; an ultraviolet radiation lamp 4 is placed coaxially inside the tube 1. When fluorescent ink 3 is illuminated by normal fluorescent lamps, or when the ink 3 is exposed to light from the sun, the ink 3 does not produce a substantial amount of color, but rather simply appears white. However, a fluorescent color is produced when the ink is illuminated by ultraviolet light emitted from the ultraviolet radiation lamp 4.

A rotary drive unit 5 is provided on one end of the tube 2 for rotating the tube 2 around its axial center line, and comprises a pair of gears 6*a* and 6*b*, and a motor 7. One of the gears or (the larger gear) 6*b* is coaxially secured to the tube 2, while the other gear or the smaller gear 6*a* is secured to the output shaft 7*a* of the motor 7.

Now the operation of this display device is described in the following with reference to FIGS. 1 and 2.

According to this display device, when the motor 7, of the rotary drive unit 5, is activated, and a voltage is applied to the ultraviolet radiation lamp 4, the tube 2 starts rotating around its axial line and ultraviolet light is radiated from the ultraviolet radiation lamp 4. The ultraviolet light is thus radiated upon the pictures g1 through g5. As a result, not only do the pictures g1 through g5 glow in the fluorescent light, but in addition, imaginary images of these pictures g1 through g5 are produced by the concave reflective surface 1*a* of the reflective plate 1; the remaining area on the surface of the tube 2, not occupied by the pictures g1 through g5, produces imaginary images projected on to a dark background.

The overall result is that the viewer can see the pictures of fish g1 through g5, as imaginary images, glowing in the fluorescent light while moving in the direction of the rotation of the tube 2 against the dark background.

According to this display device, a transparent tube 2 is placed opposite a concave reflective surface 1*a* of a reflective plate 1, while pictures are painted on the outer circumferential surface of the tube with a fluorescent ink; an ultraviolet radiation lamp is placed coaxially inside the tube, while the pictures glow in a fluorescent color due to the radiation of ultraviolet light from the ultraviolet radiation lamp. An imaginary image is produced by virtue of the concave reflective surface 1*a* of the reflective plate 1, and a dark background for the fluorescent images of the glowing fluorescent light. As a result, the pictures can be seen by the viewer as images clearly defined from the background, and the produced images are both clear and attractive to the viewer.

Figure 3:
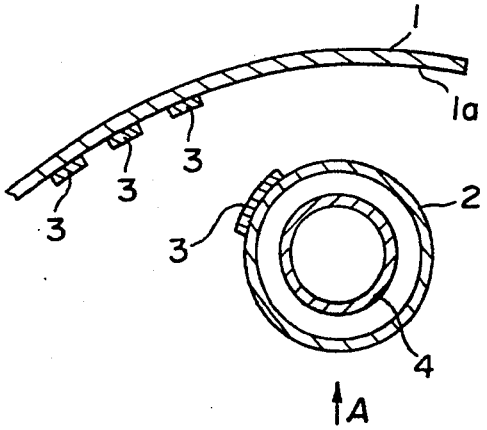
FIG. 3 is a sectional view showing a second embodiment of the display device of the present invention.
Figure 4:
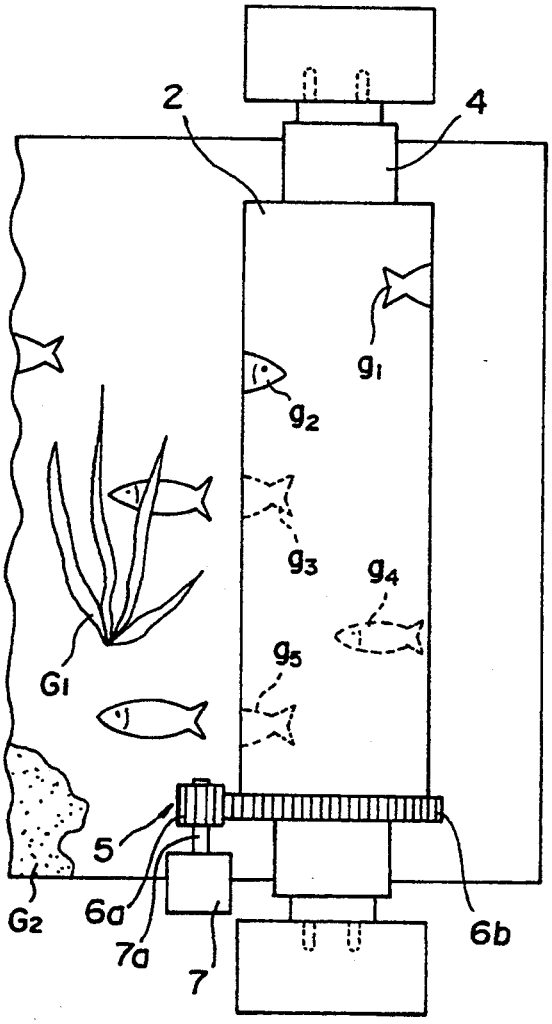
FIG. 4 is a front view of the second embodiment.

FIGS. 3 and 4 illustrate a second embodiment of the present invention, and in these drawings the parts corresponding to those of the previous embodiment are denoted with like numerals.

In this embodiment, as is best illustrated in FIG. 4, the pictures G1 and G2 of seaweed and rocks are painted directly on the reflective surface 1*a* of the reflective plate 1. Thus, in this display device, the effect produced by the pictures of fish g1 through g5 painted on the tube 2 is combined with the effect that is produced by the pictures G1 and G2, painted on the reflective surface, so that a more realistic, harmonized view of the sea bottom may be produced; on the whole, this view is achieved by combining a moving part against a stationary background.

Alternatively, the pictures on the reflective surface 1*a* as well as those on the tube 2 may be painted or printed on a film, which is then placed on the associated surface.

The operation of this display device is described in the following with reference to FIGS. 3 and 4.

According to this display device, as the tube 2 rotates around its axial center line, and ultraviolet light is emitted from the ultraviolet radiation lamp 4, the ultraviolet light is radiated not only upon the pictures g1 through g5 on the tube 2, but, also upon the pictures G1 and G2 on the reflective surface. As a result, the pictures of seaweed and rocks, G1 and G2 as well as the pictures of fish g1 through g5, radiate fluorescent light; glowing imaginary images of these pictures (g1 through g5, G1, and G2) are formed by virtue of the concave reflective surface 1*a* of the reflective plate 1. The background of the pictures of fish g1 through g5 do not emit any fluorescent light, producing a dark background for the images of the fish to glow upon.

More specifically, the produced effect is such that the images of the pictures of fish g1 through g5, produced by the reflective surface 1*a*, appear to pass behind the images of the seaweed and rocks; thus a three-dimensional appearance can be achieved.

Therefore, according to this embodiment of the display device, a three-dimensional appearance is added to the effect of the previous embodiment simply by painting objects, such as seaweed and rocks, on the reflective surface 1*a* of the reflective plate 1.

Figure 5:
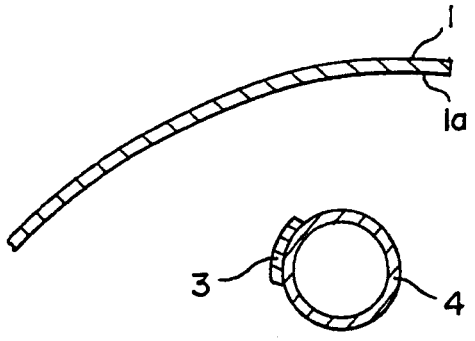
FIG. 5 is a sectional view showing a third embodiment of the display device of the present invention.

FIG. 5 illustrates a third embodiment of the present invention. In this embodiment, the tube 2 employed in the first and second embodiments is absent, and the display device essentially consists of a curved reflective plate 1 and an ultraviolet radiation lamp 4. A picture is directly painted on the surface of the ultraviolet radiation lamp 4 with fluorescent ink 3 which emits fluorescent light when ultraviolet light is radiated upon it. An electric voltage is applied to this ultraviolet radiation lamp 4, and is further adapted to rotate around its axial center line.

According to this embodiment, the ultraviolet light emitted from the ultraviolet radiation lamp 4 is directly radiated upon the pictures which are painted onto the ultraviolet radiation lamp 4 without any intervening member, such as tube 4 of the first and second embodiments. The structure of the reflective plate 1, however, is not different from those of the first and second embodiments.

In this embodiment, the pictures emitting fluorescent light, from exposure to radiation of ultraviolet light upon them, form imaginary images by virtue of the concave reflective surface 1*a* of the reflective plate 1; and the remaining surface of the ultraviolet radiation lamp 4, devoid of any fluorescent ink, produces a dark background. As a result, the produced image which is clearly and distinctively defined from the background, is highly attractive to the viewer.

Figure 6:
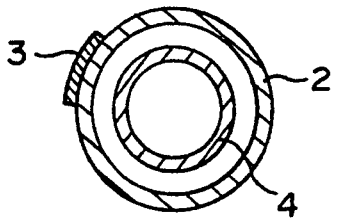
FIG. 6 is a sectional view showing a fourth embodiment of the display device of the present invention.

FIG. 6 illustrates a fourth embodiment of the present invention. In this embodiment, the curved reflective plate 1 employed in the first through third embodiments is omitted, and the display device essentially consists of a transparent tube 2, and an ultraviolet radiation lamp 4, arranged in a coaxial manner with the lamp 4 received in tube 2. Pictures such as fish are painted on the outer circumferential surface of the tube 2, and the tube 2, can be rotated around its axial center line by means of a rotary drive unit (not shown in the drawing) in the same way as in the corresponding parts of the first and second embodiments.

According to this embodiment, again, the pictures themselves emit fluorescent light by the radiation of ultraviolet light on them, while the remaining part of the outer circumferential surface of the tube 2 remains dark. As a result, the highly visible pictures stand out from the dark background, making them very attractive to the viewer.

Figure 7:
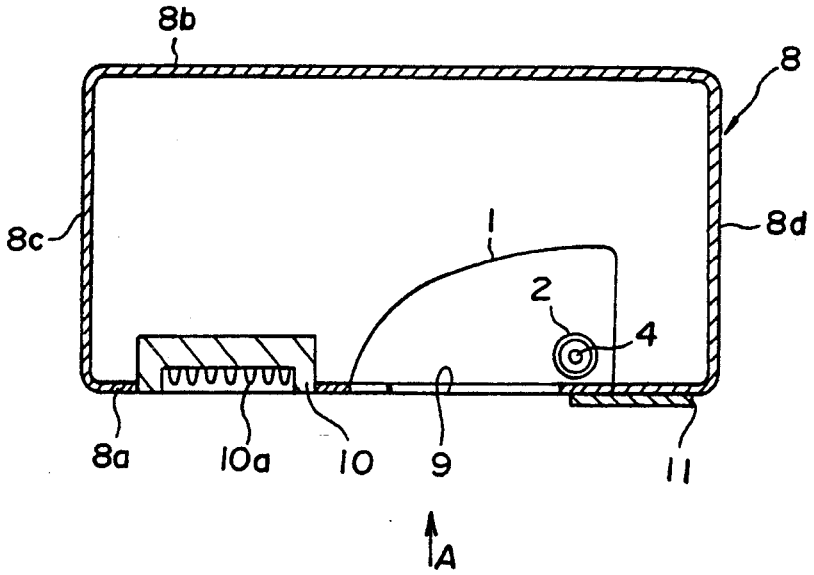
FIG. 7 is a sectional view showing a fifth embodiment of the display device of the present invention.
Figure 8:
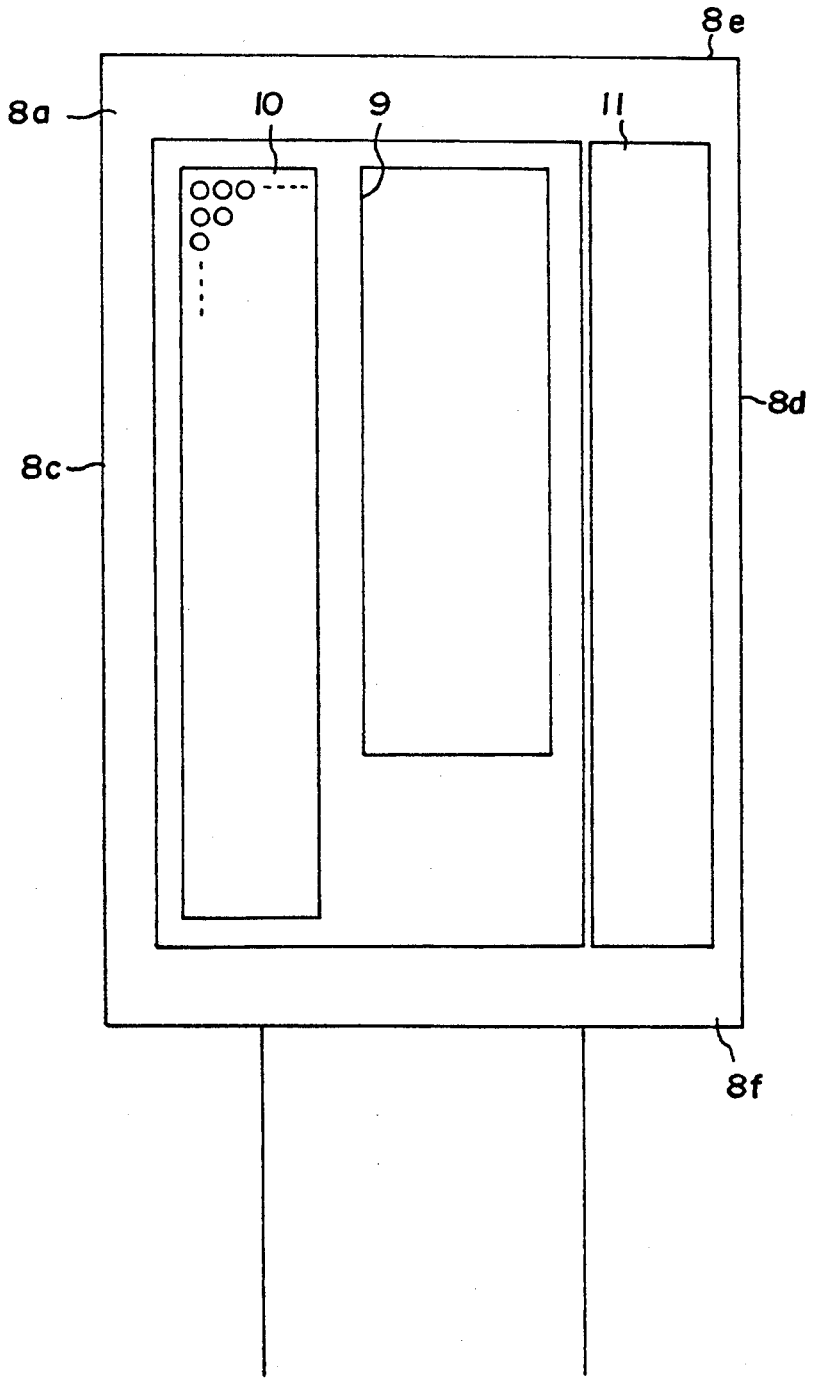
FIG. 8 is a front view of the fifth embodiment.

FIGS. 7 and 8 illustrate the fifth embodiment of the present invention. This display device comprises; a casing 8, including front and rear panels 8*a* and 8*b*, side panels 8*c* and 8*d*, a top panel 8*e*, and a bottom panel 8*f*. The front panel 8*c* is provided with a rectangular opening 9, which extends vertically in a central part of the front panel 8*c*.

A curved reflective plate 1 is accommodated in the casing 8, and its reflective surface 1*a* opposes the opening 9 of the front panel 8*a*. A transparent tube 2 is placed in front of the reflective surface 1*a*, but in such a position that it is not directly visible from the front through the opening 9. Pictures are painted on the outer circumferential surface of the tube 2 with fluorescent ink, and the tube 2 rotates around its axial center line. The ultraviolet radiation lamp 4 is coaxially received in the tube 2 in the same way that the corresponding parts of the first, second, and fourth embodiments are.

An LED display unit.10 and a plaque 11 are secured to the front panel 8*a* on opposite sides of the opening 9, respectively. The LED display unit 10 consists of a matrix of LED's 10*a* which can display pictures and letters as stationary or moving images by selectively lighting the LED's 10*a*. The plaque 11 simply displays stationary pictures and letters.

Figure 9:
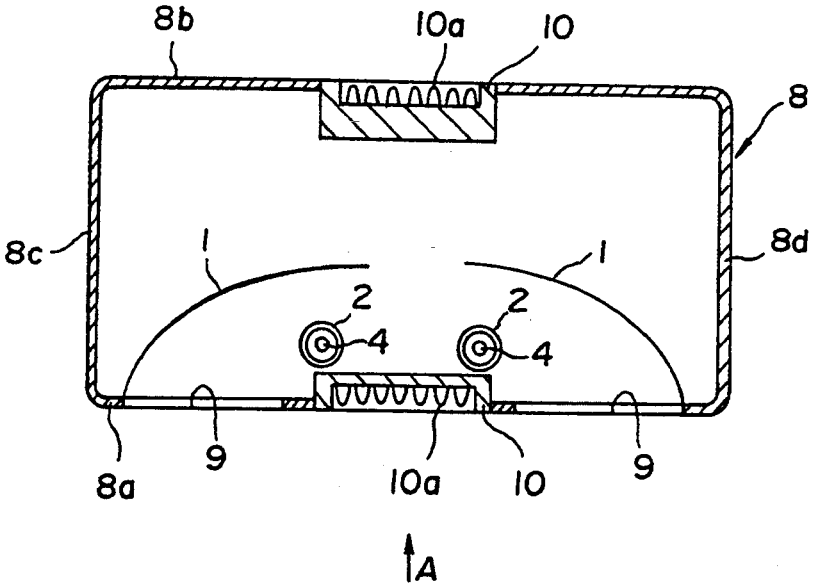
FIG. 9 is a sectional view showing a sixth embodiment of the display device of the present invention.
Figure 10:
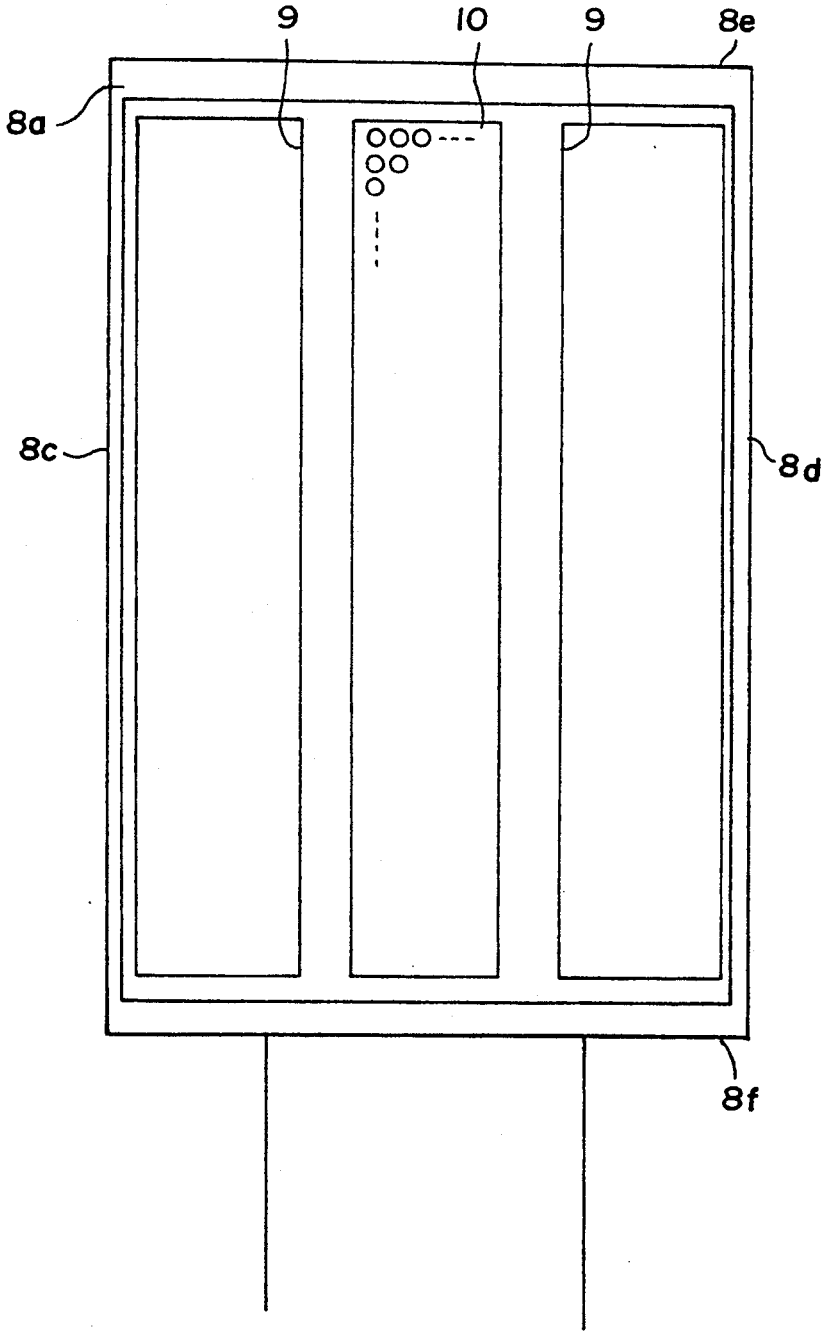
FIG. 10 is a front view of the sixth embodiment.

FIGS. 9 and 10 illustrate a sixth embodiment of the present invention which is similar to the fifth embodiment. In these drawings, the parts corresponding to those of the fifth embodiment are denoted with like numerals.

In this display device, a pair of vertically extending rectangular openings 9 are provided in the front panel 8*a* on either side of an LED display area 10 extending vertically in the central part of the front panel 8*a*. A pair of curved reflective plates 1 are placed inside the casing 8, each provided with a concave reflective surface 1*a* opposing the corresponding opening 9. A transparent tube 2 is placed in front of each of the reflective surfaces 1*a* in such a position that it is not visible from the front through the corresponding opening 9. Each of the tubes 2 coaxially receives an ultraviolet radiation lamp 4 in the same way as in the previous embodiment. In this embodiment, an additional LED display area 10 is provided in the rear panel 8*b* of the casing 8. Its structure is identical to the LED display area 10 provided in the front panel 8*a*.

Figure 11:
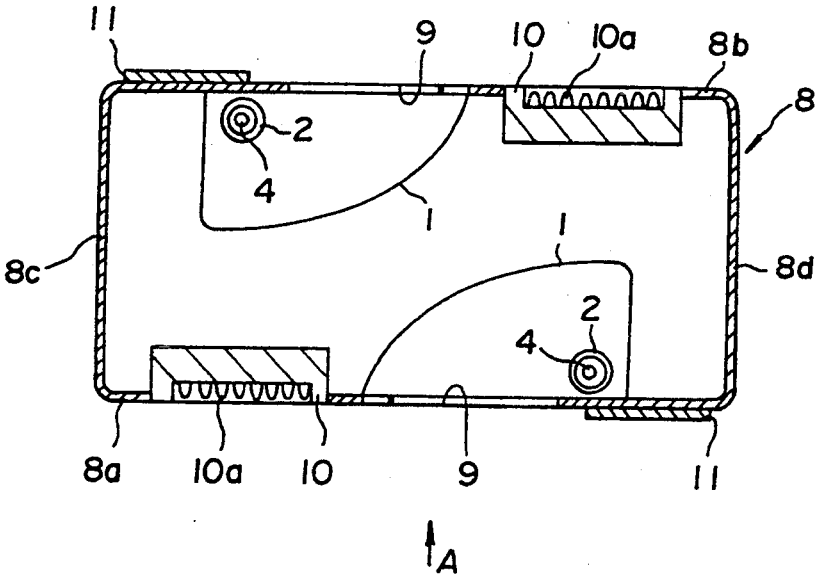
FIG. 11 is a sectional view showing a seventh embodiment of the display device of the present invention.
Figure 12:
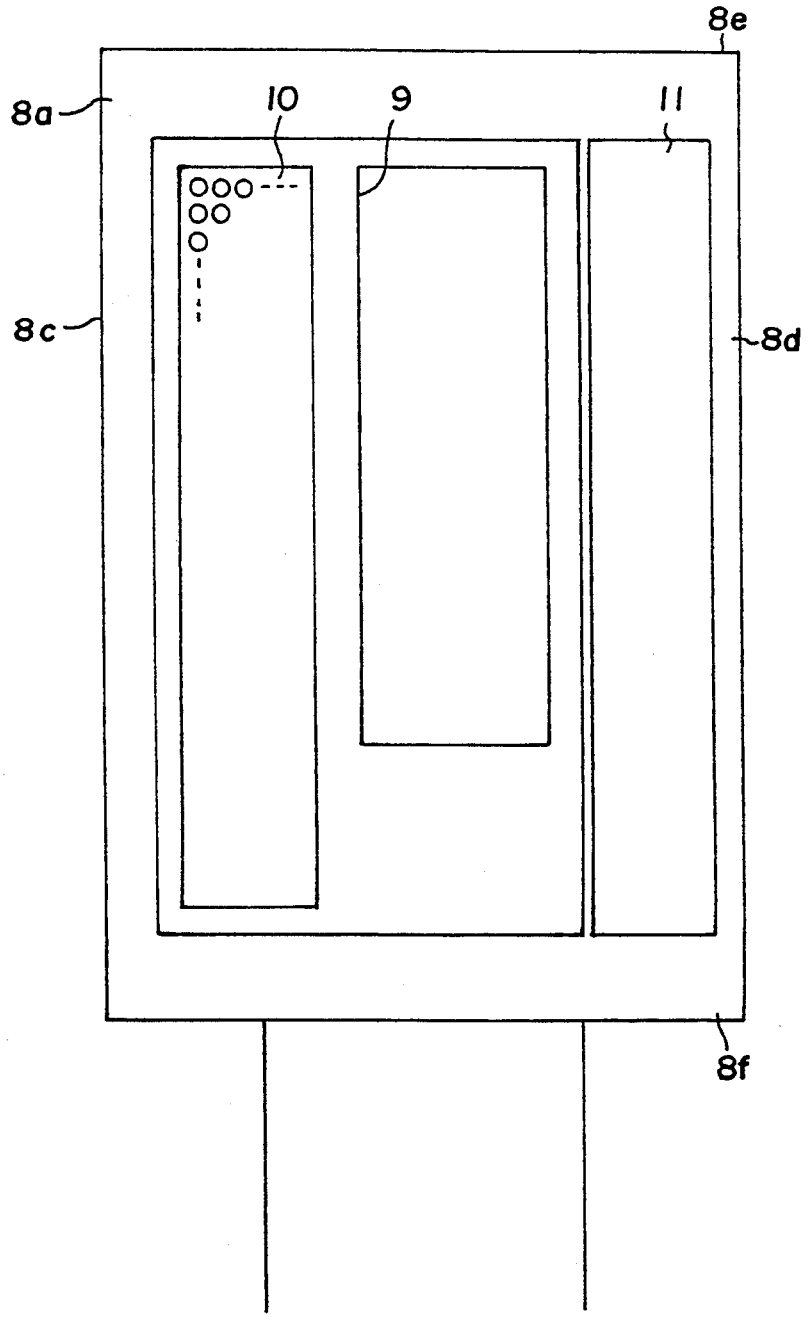
FIG. 12 is a front view of the seventh embodiment.

FIGS. 11 and 12 illustrate a seventh embodiment of the present invention. In these drawings, the parts corresponding to those of the fifth embodiment are denoted with like numerals.

This embodiment is similar to the fifth embodiment, but the difference is that the structure for the front panel 8*a* of the fifth embodiment is employed for both the front and rear panels 8*a* and 8*b* of the seventh embodiment. More specifically, referring to FIG. 11, the reflective plate 1, the tube 2, the opening 9, the LED display area 10, and the plaque 11 of the rear panel 8b coincide with the corresponding parts of the front panel 8a when the entire structure is rotated by 180 degrees around a central axial line. In other words, the structure of the front and rear panels 8a and 8b look identical to the viewer.

Figure 13:
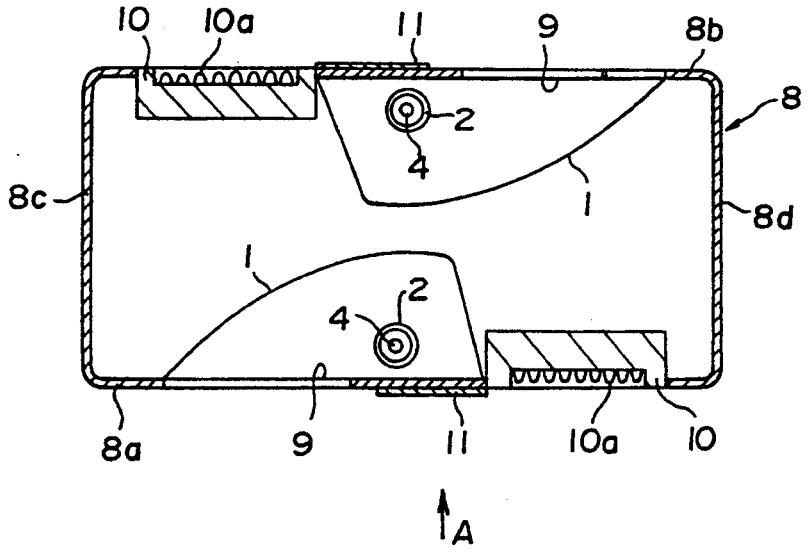
FIG. 13 is a sectional view showing a eighth embodiment of the display device of the present invention.
Figure 14:
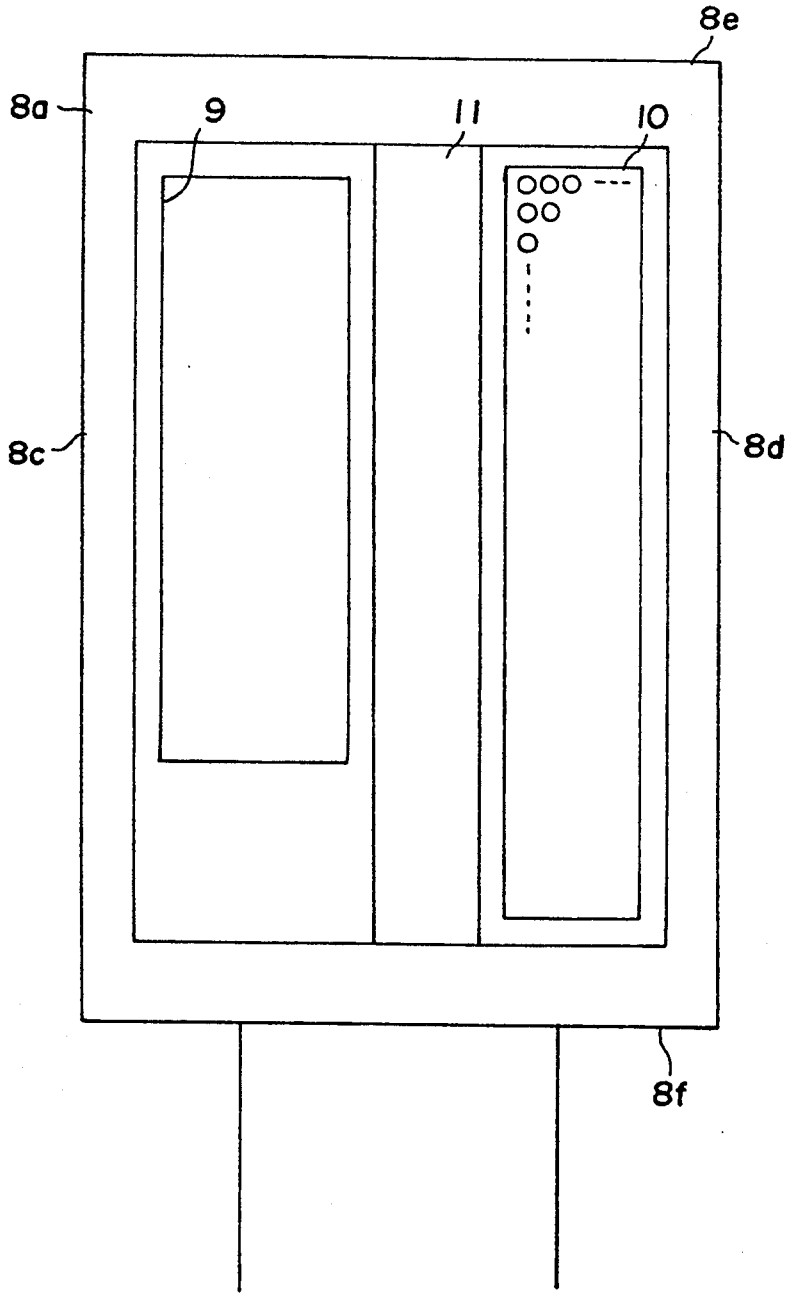
FIG. 14 is a front view of the eighth embodiment.

FIGS. 13 and 14 illustrate an eighth embodiment of the present invention which is similar to the seventh embodiment. In this case, however, a plaque 11 provided in the central part of each of the front and rear panels, is flanked by an opening 9 and an LED display unit 10. Each of these elements are substantially identical in structure to the corresponding elements of the previous embodiment.

Figure 15:
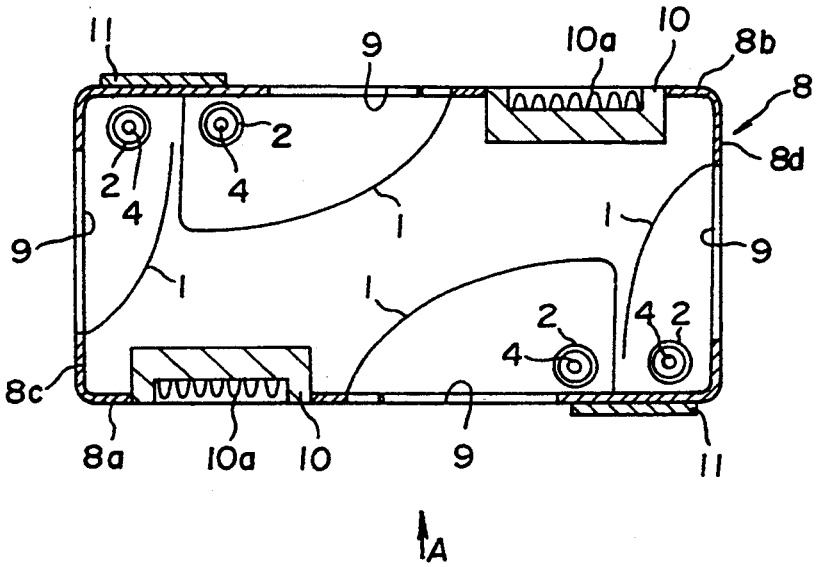
FIG. 15 is a sectional view showing a ninth embodiment of the display device of the present invention.
Figure 16:
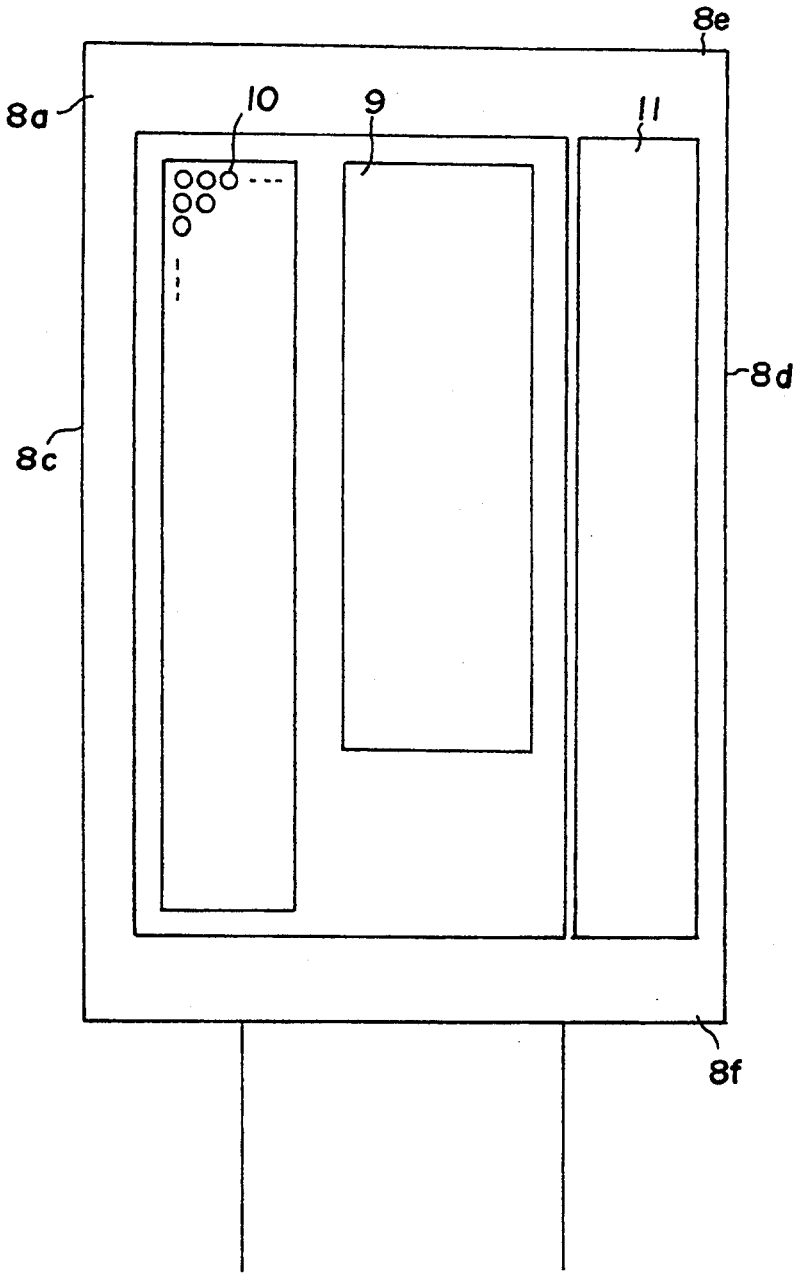
FIG. 16 is a front view of the ninth embodiment.
Figure 17A:
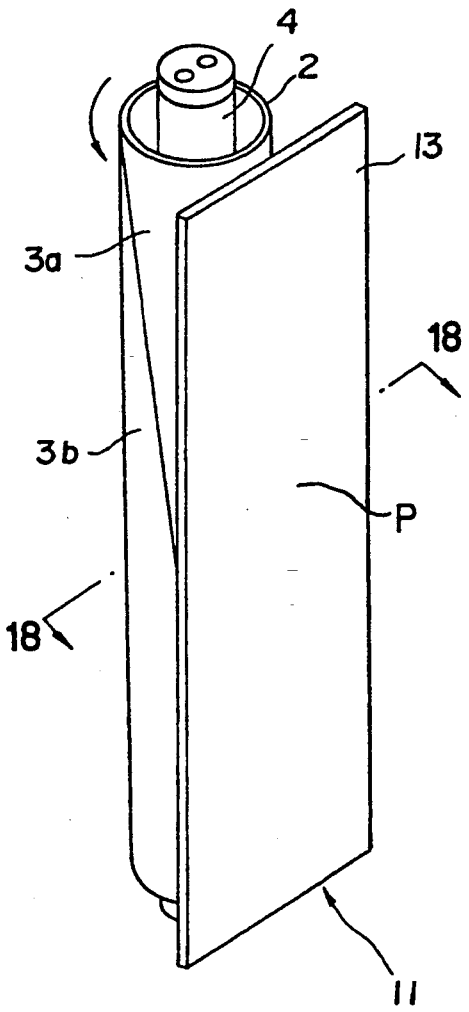
FIG. 17*a* is a perspective view of a tenth embodiment of the present invention.
Figure 17B:
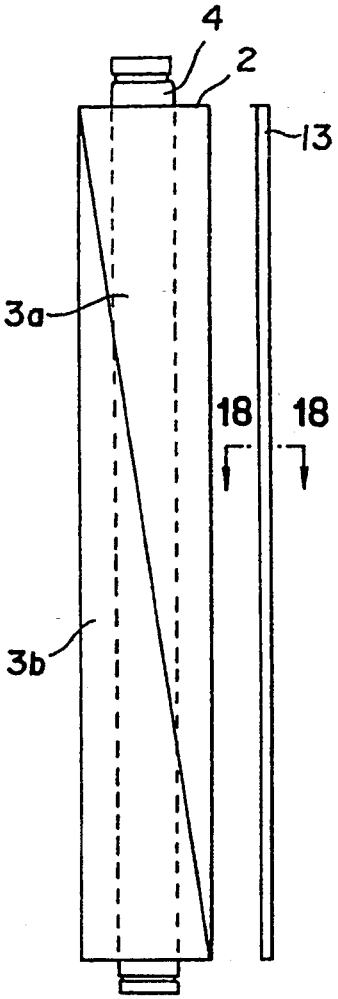
FIG. 17*b* is a side view of the tenth embodiment.
Figure 18:
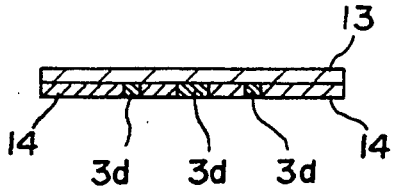
FIG. 18 is a fragmentary sectional view of the plate used in the tenth embodiment taken along 18—18 in FIG. 17*b;*
Figure 19:
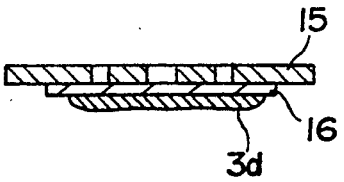
FIG. 19 is a view similar to FIG. 18 showing the plate according to the eleventh embodiment of the present invention taken along 18—18 in FIG. 17*b;*

FIGS. 15 and 16 illustrate a ninth embodiment of the present invention. In these drawings, the parts corresponding to those of the fifth embodiment are denoted with like numerals.

This embodiment is similar to the eighth embodiment, but is provided with two additional openings 9; one on each of the side panels 8c and 8d. Furthermore, when directly facing and viewing either the front or the real panel, the opening 9 is located on the right hand side of the panel in view, while the LED display panel 10 is located on the left hand side of the panel in view. Thus, as seen in the cross sectional view of FIG. 15, one pair of the openings 9 or one pair of the reflective plates 1 adjoin each other at the lower right corner of the casing 8. Similarly, the other pair of the openings 9 or the other pair of the reflective plates 1 adjoin each other at the upper left corner of the casing 8.

The structure of each reflective plate 1 as well as that of the corresponding opening 9, the tube 2, the ultraviolet radiation lamp 4, is similar to that of the previous embodiments. According to this embodiment, the favorable effect of the present invention can be achieved regardless of the direction that the display device is viewed from.

If desired, the LED display areas 10 may be replaced by plaques for fixed display. Furthermore, any one of the LED display areas 10 used in the embodiments described above may be replaced by a plaque, or vice versa.

FIGS. 17a, 17b, 18 and 19 show an example of a plaque which may be used with the display device of the present invention. The plaque 11 comprises a transparent tube 2 which is placed behind a transparent plate 13 with slight spacing separating the two. A multiplicity of spirals are drawn or painted on the outer circumferential surface of the tube 2 with fluorescent inks of different colors 3a and 3b. An ultraviolet radiation lamp 4 is coaxially disposed inside this tube 2 in the same way as in the previous embodiments.

Letters P are drawn on the transparent plate 13 with fluorescent ink 3d of different colors from those used to paint the spirals on the tube 2. The remaining area of the transparent plate 13 is covered by an opaque mask 14. The mask 14 may consist of an area painted with opaque ink which does not emit fluorescent light when ultraviolet light is radiated on it, or it may consist of an opaque sheet. The mask 14 may be omitted from the display when desired. Alternatively, the transparent plate 13 may consist of a metallic plate in which openings are made in the shape of desired letters. These openings are covered with transparent film 16, which is then painted with fluorescent ink 3d.

According to this plaque 11, as ultraviolet light is emitted from the ultraviolet radiation lamp 4, onto the tube 2 as it rotates around its axial center line, the fluorescent inks 3a and 3b on the tube emit light in different colors; furthermore, the fluorescent ink 3c on the plate 13 emit light as well. As a result, the letters P on the transparent plate 13 glow in colors which are mixed and gradually change with time as the tube 2 rotates.

With regard to the plaques 11 in the fifth, and in the seventh through ninth embodiments described above, the tube 2 may be omitted; the plaque 11 may consist solely of a transparent plate 13 displaying letters painted with fluorescent ink, with an ultraviolet radiation lamp 4 placed behind it.

The ultraviolet radiation lamps used in the abovedescribed embodiments may consist of the so-called black light blue fluorescent lamp which only emits near ultraviolet light (300 nm to 400 nm) by using a tube made of special glass which is opaque to visible light; or it may consist of the black light fluorescent lamp, which emits ultraviolet light with a similar wavelength range, even though it uses a glass tube which is no different from that used in normal fluorescent lamps for illumination.

In particular, the black light blue fluorescent lamp presents a dark (dark blue) appearance when both lighted and non-lighted, as opposed to the black light fluorescent lamp which presents a lighted or white appearance to the naked eye depending on whether it is lighted or not. Therefore, when the black light blue fluorescent lamp is used, the reflective surface produces a dark blue background; as a result, the pictures and letters to be displayed stand out better from the background and are clearly visible.

The fluorescent ink may be selected from any of the commercially available fluorescent inks which glow when ultraviolet light is radiated upon them, whether they glow in the UV short wave (254 nm) or in the UV long wave (365 nm). Furthermore, the pictures may be painted in any manner; they may be painted by hand, or the paint may be applied with the aid of a printing device for curved surfaces.

In the third, and in the fifth through ninth embodiments, it is by choice that no picture is painted on the reflective surface, but, various pictures and letters may be painted on the reflective surfaces if desired. In the fifth through ninth embodiments, an ultraviolet radiation lamp 4 is placed inside a transparent tube 2, but it is also possible to omit this transparent tube 2, and paint the pictures directly onto the outer circumferential surface of the ultraviolet radiation lamp with fluorescent ink. In this case, the ultraviolet radiation lamp 4 must be capable of rotating around its axial line while a prescribed voltage is applied to its two ends.

In the first through the ninth embodiments, pictures are painted on the outer surface of the tube as well as the reflective surface of the reflective plate, but, it goes without saying that letters, or any image for that matter, instead of pictures may be painted on them.

Figure 20A:
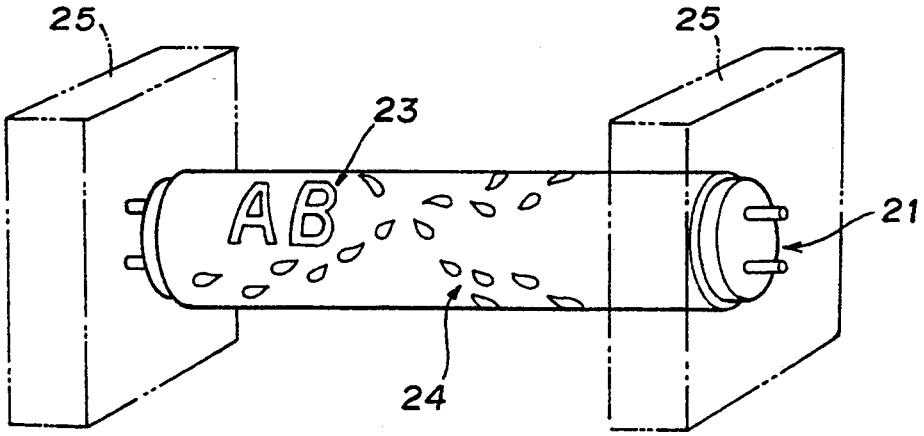
FIG. 20*a* is a perspective view of a twelfth embodiment of the present invention.
Figure 20B:
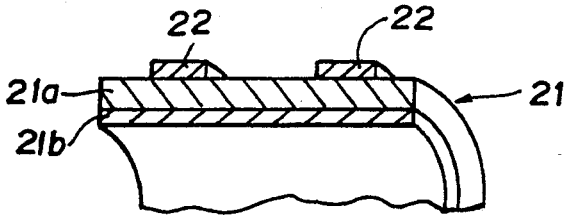
FIG. 20*b* is a partly detached, fragmentary perspective view of the glass tube of the ultraviolet radiation lamp used in the twelfth embodiment.

FIGS. 20a and 20b illustrate such an embodiment in which letters 23 and pictures 24 are painted directly on the outer circumferential surface of an ultraviolet radiation lamp 21. The ultraviolet radiation lamp 21 comprises a glass tube 21a, and a fluorescent layer 21b, which is coated on the inner circumferential surface of the glass tube 21; the layer is made of material which emits ultraviolet light when it is energized by the electric discharge taking place inside of the glass tube, as is well known in the art. The fluorescent ink 22, by which the letters 23 and the pictures 24 are painted, looks white under the normal illumination of fluorescent light or the sun, which produces relatively little ultraviolet light; but, the ink emits light of a certain color when ultraviolet light of a high intensity, produced by the ultraviolet radiation lamp 21, is radiated upon it.

The display device may derive its electric power from an ordinary AC outlet, or it may be fitted into a pair of sockets 25 used for mounting a normal fluorescent lamp. If desired, the display device of this embodiment may be used as a replacement for a normal fluorescent lamp in public places. When the ultraviolet radiation lamp 21 is lighted, the letters 23 and the pictures 24 glow against the dark background, and even from a distance, are clearly visible and highly attractive to look at.

Figure 21A:
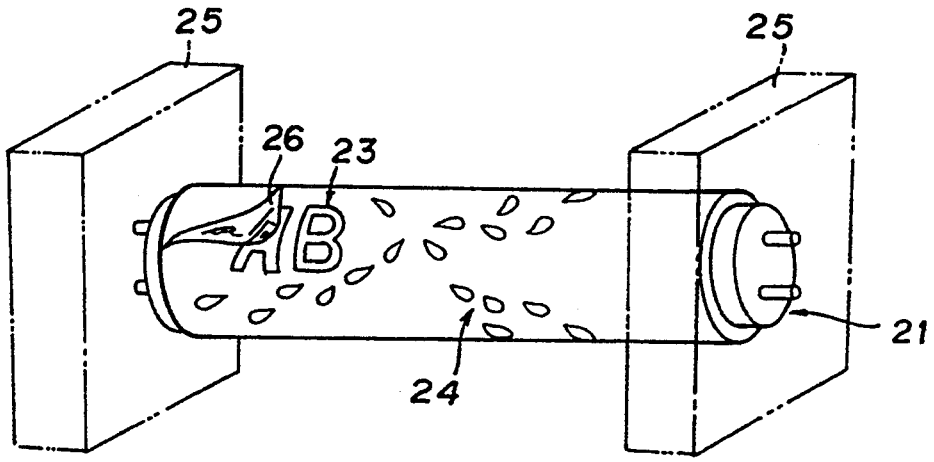
FIG. 21*a* is a perspective view of a thirteenth embodiment of the present invention.
Figure 21B:
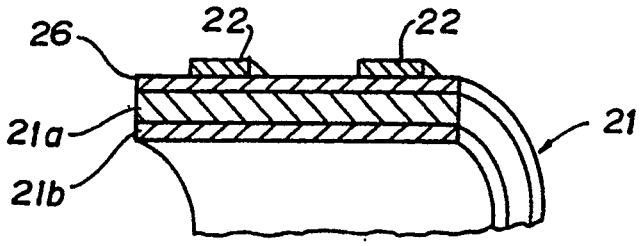
FIG. 21*b* is a partly detached, fragmentary perspective view of the glass tube of the ultraviolet radiation lamp used in the thirteenth embodiment.

FIGS. 21*a* and 21*b* illustrate an embodiment which is similar to the previous embodiment. In these drawings, the parts corresponding to those illustrated in FIGS. 20*a* and 20*b* are denoted with like numerals.

In this embodiment, a film 26 is placed over the outer circumferential surface of the ultraviolet radiation lamp 21, and letters 23 and pictures 24 are painted on this film 26, instead of the outer circumferential surface of the ultraviolet radiation lamp 21 itself. The film 26 may consist of any practical material, such as transparent or tinted polyvinyl chloride, as well as others, as long as the film can transmit ultraviolet light, and can be bonded on the outer circumferential surface of the ultraviolet radiation lamp 21. Furthermore, it is obvious that the surface should be suitable for printing.

Now the method of fabricating this display device, as well as the function thereof, is described in the following.

According to this display device, the letters 23 and the pictures 24 are printed on the surface of the film 26 by a suitable means, such as a screen printing machine; thus, the printed film 24 is bonded to the outer circumferential surface of the ultraviolet radiation lamp 21 with a bonding agent, or by using the heat-shrinking property of the film 26.

According to this embodiment, desired letters and pictures can be printed on the film with commonly available printing machines such as screen printing machines, without requiring any special printing machines for curved surfaces.

Although the ultraviolet radiation lamps consisted of straight line lamps, they may also consist of circle line lamps or round bulb lamps.

The present invention is extremely useful for conveying messages because the displayed images, such as pictures and letters, are clearly visible and unmistakably recognized by the viewer. Furthermore, the display device of the present invention displays images in a highly attractive manner, making it a very effective and suitable tool for advertisement and ornamental purposes.

Although the present invention has been described in terms of specific embodiments thereof, it is possible to modify and alter details thereof without departing from the spirit of the present invention.

What we claim is:

1. A display device comprising:

an ultraviolet radiation lamp; and an image disposed directly on an outer surface of said ultraviolet radiation lamp with a fluorescent ink which emits light when ultraviolet light emitted from said ultraviolet radiation lamp is radiated upon.

2. A display device according to claim 1, further comprising a means for rotating said ultraviolet radiation lamp.

3. A display device, comprising a hollow casing having a plurality of sides, wherein at least one of said sides includes:

an opening;

an assembly consisting of an ultraviolet radiation lamp, and a substantially transparent tube coaxially receiving said ultraviolet radiation lamp therein, said assembly being disposed inside said casing so as to be hidden from a direct view through said opening;

an image painted or printed on a surface of said tube with a fluorescent ink which emits light when ultraviolet light emitted from said ultraviolet radiation lamp is radiated upon;

a means for rotating said transparent tube around an axial center line thereof; and a reflective plate, having a concave reflective surface facing an assembly consisting of said transparent tube and said ultraviolet radiation lamp, said reflective plate being placed behind said assembly as seen from the viewer in such a manner that said reflective surface forms an imaginary image, of said image on said tube, which can be viewed through said opening.

4. A display device according to claim 3, wherein an image is painted or printed on a reflective surface of said reflective plate.

5. A display device, comprising:

an ultraviolet radiation lamp; and an image provided on a substantially transparent film which is placed directly on an outer surface of said ultraviolet radiation lamp, said image being formed with a fluorescent ink which emits light when ultraviolet light emitted from said ultraviolet radiation lamp is radiated upon.

6. A display device, comprising:

an ultraviolet radiation lamp;

a substantially transparent tube coaxially receiving said ultraviolet radiation lamp therein;

a means for rotating said transparent tube around an axial center line thereof;

an image disposed on a surface of said tube and formed of a fluorescent ink which emits light when ultraviolet light emitted from said ultraviolet radiation lamp is radiated upon;

a reflective plate, having a concave reflective surface, facing an assembly consisting of said transparent tube and said ultraviolet radiation lamp, said reflective plate being placed behind said assembly as seen from the perspective of a viewer of said assembly; and a means for hiding said assembly from direct view of said viewer.

7. A display device according to claim 6, wherein an image is painted or printed on a reflective surface of said reflective plate.

8. A display device, comprising:

an ultraviolet radiation lamp;

a substantially transparent tube coaxially receiving said ultraviolet radiation lamp therein;

a means for rotating said transparent tube around an axial center line thereof;

a plaque placed in front of an assembly consisting of said transparent tube and of said ultraviolet radiation lamp, and consisting of a substantially transparent plate; and an image disposed on a surface of said tube and formed of a fluorescent ink which emits light when ultraviolet light emitted from said ultraviolet radiation lamp is radiated upon.

9. A display device, comprising:

an ultraviolet radiation lamp;

a substantially transparent tube coaxially receiving said ultraviolet radiation lamp therein;

a means for rotating said transparent tube around an axial center line thereof;

an image disposed on a surface of said tube and formed of a fluorescent ink which emits light when ultraviolet light emitted from said ultraviolet radiation lamp is radiated upon;

a plaque made of a substantially opaque plate placed in front of an assembly consisting of said transparent tube and of said ultraviolet radiation lamp, and having an opening of a prescribed shape; and a transparent sheet covering said opening, said transparent sheet being coated with said fluorescent ink which emits light when ultraviolet light emitted from said ultraviolet radiation lamp is radiated upon it.

* * * * *